US006981387B1

(12) United States Patent
Morgan

(10) Patent No.: US 6,981,387 B1
(45) Date of Patent: Jan. 3, 2006

(54) APPARATUS FOR DELIVERING CARBONATED LIQUID AT A TEMPERATURE NEAR OR BELOW THE FREEZING POINT OF WATER

(76) Inventor: Louis A. Morgan, 805 Rancho Estates Blvd., Yukon, OK (US) 73099

( * ) Notice: Subject to any disclaimer, the term of this patent is extended or adjusted under 35 U.S.C. 154(b) by 117 days.

(21) Appl. No.: 10/687,049

(22) Filed: Oct. 16, 2003

Related U.S. Application Data

(60) Provisional application No. 60/428,333, filed on Nov. 22, 2002.

(51) Int. Cl.
*B67D 5/62* (2006.01)
*B67D 5/56* (2006.01)
*E03B 1/00* (2006.01)

(52) U.S. Cl. ..... 62/390; 62/389; 137/594; 137/602; 222/129; 222/146

(58) Field of Classification Search ..... 62/389, 62/390; 137/594, 602; 222/129, 146
See application file for complete search history.

(56) References Cited

U.S. PATENT DOCUMENTS 1,501,874 A 7/1924 Wardenburg
4,201,558 A * 5/1980 Schwitters et al. ..... 62/70
4,866,949 A 9/1989 Rudick
4,970,871 A 11/1990 Rudick
5,011,700 A * 4/1991 Gustafson et al. ..... 426/477
5,140,832 A 8/1992 Deninger
5,310,088 A * 5/1994 Burrows ..... 222/67
5,524,452 A * 6/1996 Hassell et al. ..... 62/389
5,715,700 A * 2/1998 Credle, Jr. ..... 62/390
6,276,150 B1 8/2001 Nelson
6,301,918 B1 10/2001 Quartarone
6,626,005 B2 * 9/2003 Schroeder ..... 62/306
6,698,229 B2 * 3/2004 Renken et al. ..... 62/390
6,725,687 B2 * 4/2004 McCann et al. ..... 62/389
6,761,036 B2 * 7/2004 Teague et al. ..... 62/70

* cited by examiner

*Primary Examiner*—Cheryl Tyler
*Assistant Examiner*—Filip Zec
(74) *Attorney, Agent, or Firm*—Randal D. Homburg

(57) ABSTRACT

A double tank refrigerated carbonated beverage dispensing apparatus for blending fresh water and carbon dioxide to produce a carbonated liquid delivered to a faucet bank for dispensing mixed soft drinks at a temperature at or below the freezing point of water, includes a double tank carbonator having in inner tank contained within an outer tank, insulated by a void between the two tank, the void having refrigeration coils connected to a refrigeration circulation system. The apparatus includes a soda water circulating system, a heat exchange unit for pre-cooling water and beverage syrup lines, syrup coils adapted to the double tank carbonator for chilling some beverage syrup lines, temperature sensors for regulating temperature of the carbonated water and fluid level probes to regulate the amount of water delivered to the double tank carbonator.

11 Claims, 10 Drawing Sheets

APPARATUS FOR DELIVERING CARBONATED LIQUID AT A TEMPERATURE NEAR OR BELOW THE FREEZING POINT OF WATER

CROSS REFERENCE TO RELATED APPLICATIONS

Provisional Patent Application No. 60/428,333 filed Nov. 22, 2002.

I. BACKGROUND OF THE INVENTION

1. Field of Invention

A double tank system and refrigerated compressor device for mixing water and carbon dioxide to produce a carbonated liquid within an inner tank, cooled by compressor coils attached to the inner tank, placed within the outer tank, with a vacuum or a highly insulated foam placed in a void between the inner tank and the outer tank, delivering the chilled carbonated water product to a faucet bank for mixing with a cooled beverage syrup, providing the carbonated beverage at a temperature at or below the freezing point of water, due to the enhanced cooling ability of the system and device.

2. Description of Prior Art

The following United States patents were discovered and are disclosed within this application for utility patent. All relate to a type of beverage dispenser having a compressor which delivers a produce at a reduced temperature or in a frozen state.

In U.S. Pat. No. 6,276,150 to Nelson, a beverage is mixed with carbon dioxide and then through a chiller, then further delivered to the primary target of the invention, which is the faucet or dispenser, allowing ice into the cup, followed by the cooled beverage through the same faucet means. It contains no double tank system nor claim of delivering a liquid at or below 32 degrees F. A frozen beverage, which has entered a state of crushed ice is the delivery subject of the dispenser in U.S. Pat. No. 6,301,918 to Quartarone, which also utilizes an auger to lift the frozen product into an expulsion tube to deliver the frozen product to an outlet.

A single tank carbonator is disclosed in the beverage dispenser of U.S. Pat. No. 5,140,832 to Deininger, which is the common state of the prior art. U.S. Pat. Nos. 4,866,949 and 4,970,871 to Ridick demonstrate refrigerators with single tank carbonators incorporated within the refrigerator.

The present apparatus discloses an inner tank within an outer tank, with the refrigerant coils positioned on the outer surface of the inner tank, the inner tank and outer tank also being sealed within each other with a vacuum between the two tanks or some other insulation material, a pre-chiller or heat exchanger, and also incorporates syrup tubes within the inner tank for the pre-cooling of the syrup before being mixed with the carbonated liquid at the delivery faucet.

II. SUMMARY OF THE INVENTION

The current state of the beverage dispenser industry provides several mechanisms to provide a carbonated beverage to a customer by mixing water, carbon dioxide gas and a flavored syrup in a cooled environment with the mixed beverage delivered to one or more faucets on a counter top drink dispenser. The temperature of the dispensed beverage varies to a great extent, but no current machine is able to deliver the beverage to the faucet at or below freezing, the temperature of the beverage at the faucet being somewhere around 40 degrees. In addition, only so much liquid may be chilled by the current machines before the liquid being dispensed starts being delivered at even higher temperatures, exceeding the cooling capacity of the machines. Also significant in effecting these current machines in the environmental temperature surrounding the machines, outdoor dispensers being a greater challenge to regulate than indoor dispensers.

The present apparatus delivers the mixed soft drink beverage to the faucet at or below the freezing temperature of water which provides several benefits over the prior art. First, an advantage is gained by the beverage being less likely to melt the ice in a beverage glass upon dispensing the beverage, slowing the process of the ice turning to water which would dilute the beverage once dispensed. A second advantage is gained by the apparatus allowing for a greater volume of beverage being able to be dispensed at a lower temperature than the prior art devices because the inner tank of the double tank carbonator is not exposed to the environment surrounding the prior art carbonators, being insulated from the environment by either the vacuum in the void between the inner tank and outer tank or a highly insulating foam product. A third advantage lies in the cooling coils being contained within the same void as the inner tank, making the cooling coils transfer their cooling properties more efficiently to the inner tank and its contents than if the cooling coils were exposed to the environment of the prior art devices. This allows the refrigerant circulating system to run less often than the prior are systems, saving costs for energy required to operate the refrigerant circulating systems, which is the bulk of the cost of operation of these type of beverage dispensing units.

Noted in the apparatus is a distinction between diet syrup lines and sugared syrup lines. This is due to the effect of temperature on these ingredients. Sugared syrups may be chilled below the freezing point of water without effect on the diet syrup, to some extent, provided that the sugared syrup is not frozen. However, with diet syrup, especially when flavored with the current artificial sweetener ingredients, these sweeteners are broken down when chilled too close to the freezing point of water, and can alter the flavorings to the point of making these artificial sweeteners become bitter. Therefore, the diet syrup lines are channeled through a heat exchange unit, cooled by fresh water, prior to delivery to the faucet bank, while the sugared syrup lines are optionally channeled through syrup coils traversing the inner tanks, lowering the sugared syrup to a temperature similar to the carbonated water.

The primary objective of the apparatus is to provide a beverage dispensing apparatus which delivers a carbonated beverage to its faucets at or below the freezing point of water by providing the apparatus with an inner tank within an outer tank with cooling coils between the two tanks in an environment not affected by outside factors including heat, air pressure or adverse weather conditions.

A secondary objective of the apparatus is to provide a more economically efficient method and space convenient component arrangement for pre-cooling the components being mixed into a carbonated beverage prior to their being combined and delivered to the faucet to enhance the efficiency of the beverage dispenser for lower the cost of operation. A third objective would be to provide the apparatus in a counter top embodiment for restaurant and concession use which is less effected by the surrounding environment of the location of the apparatus.

III. DESCRIPTION OF THE DRAWINGS

The following drawings are submitted with this utility patent application.

Figure 7A:
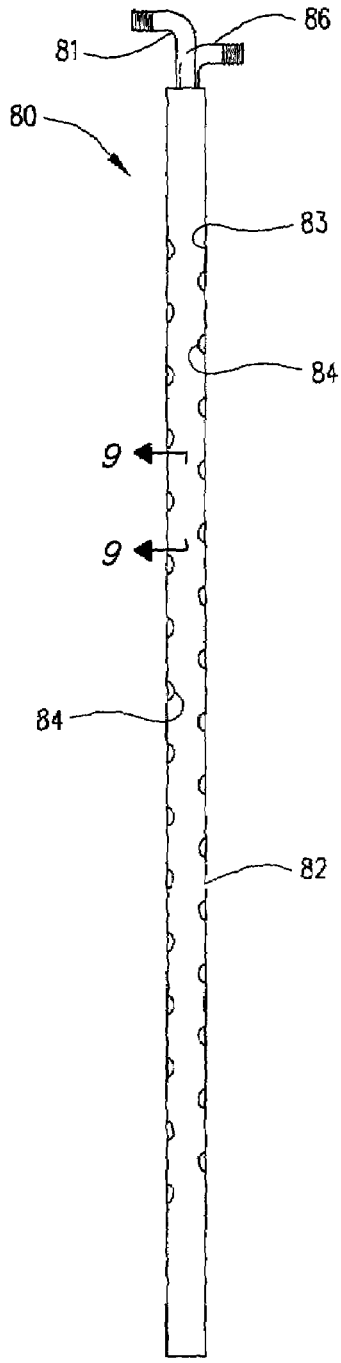

FIG. 7*a* is a side view of a syrup tube.

Figure 7B:
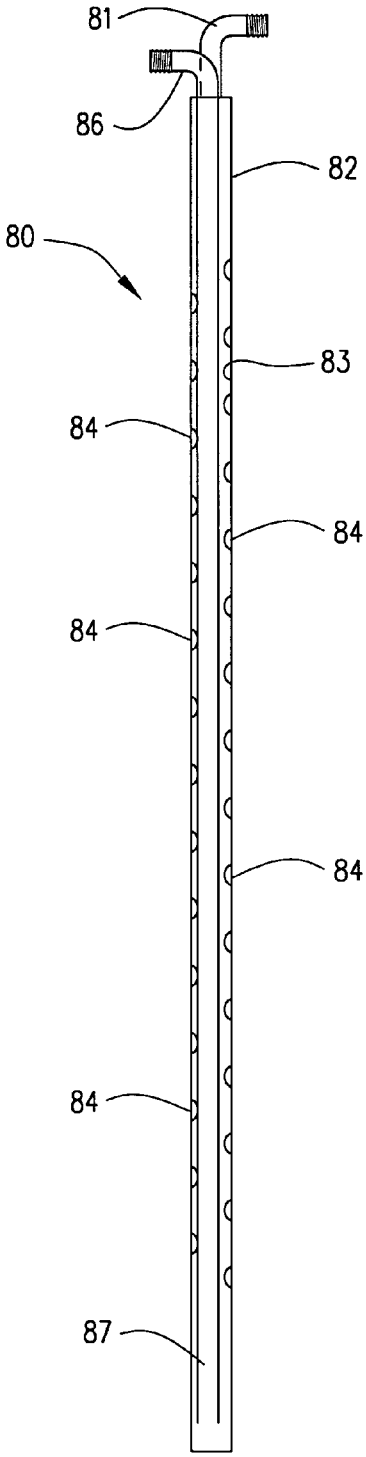

FIG. 7*b* is a side cross section of the syrup tube.

Figure 8:
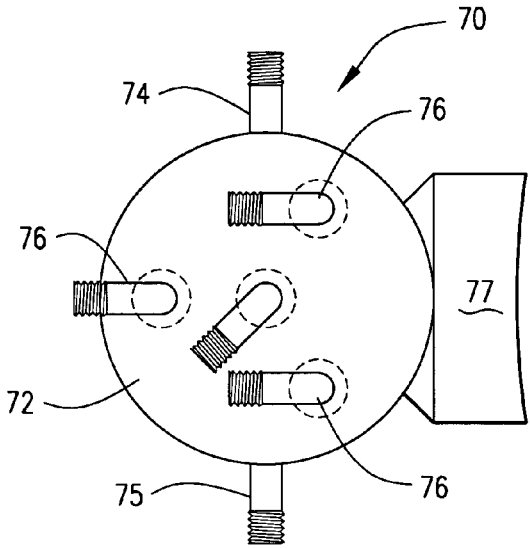

FIG. 8 is a top view of the heat exchange unit.

Figure 9:
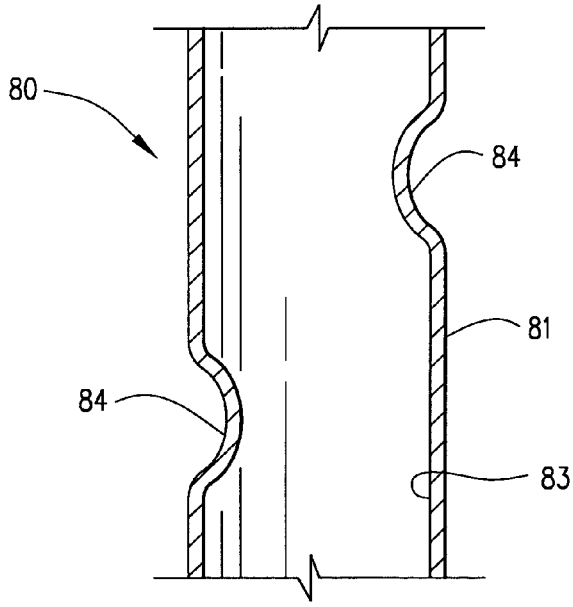

FIG. 9 is a cross section of the outer syrup coil tube.

Figure 10:
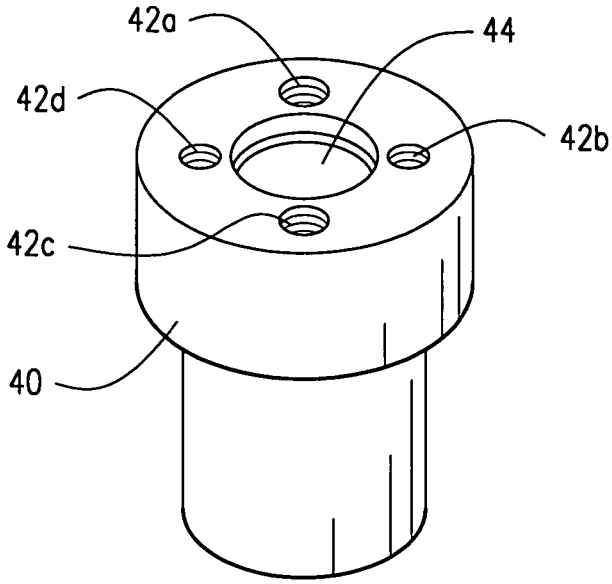

FIG. 10 is a perspective view of the hub.

Figure 11:
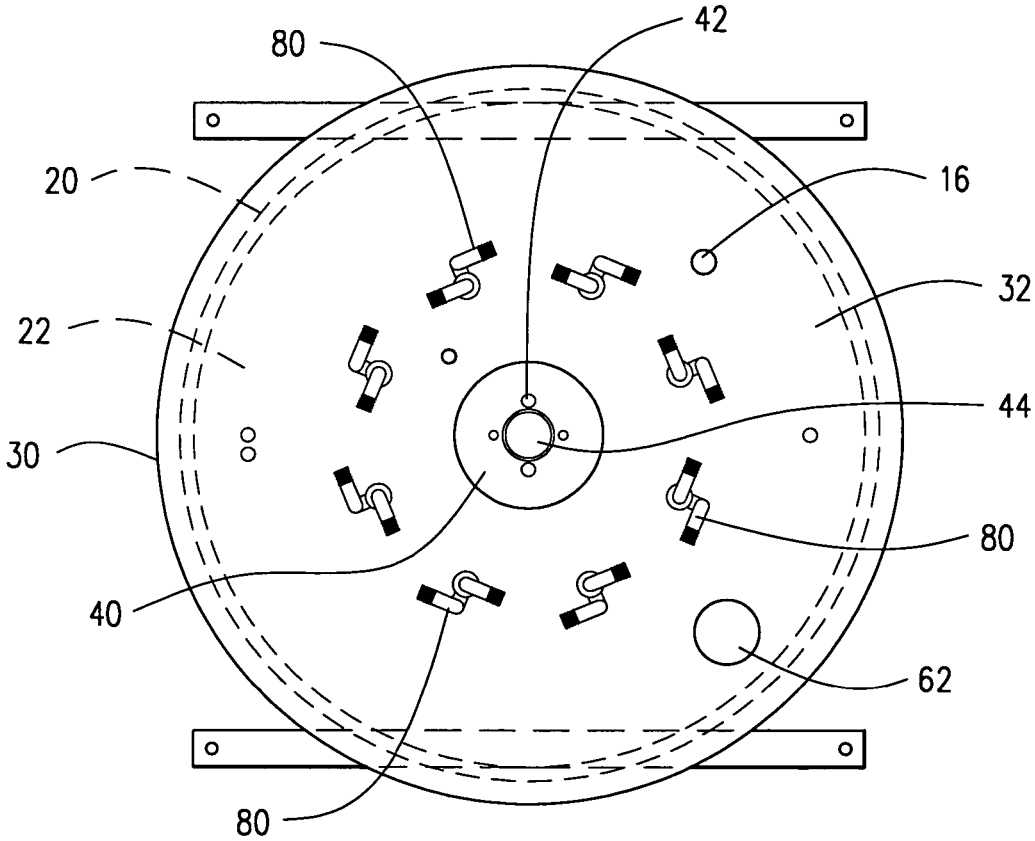

FIG. 11 is a top view of the outer tank indicating the placement of the plurality of syrup coils.

Figure 12:
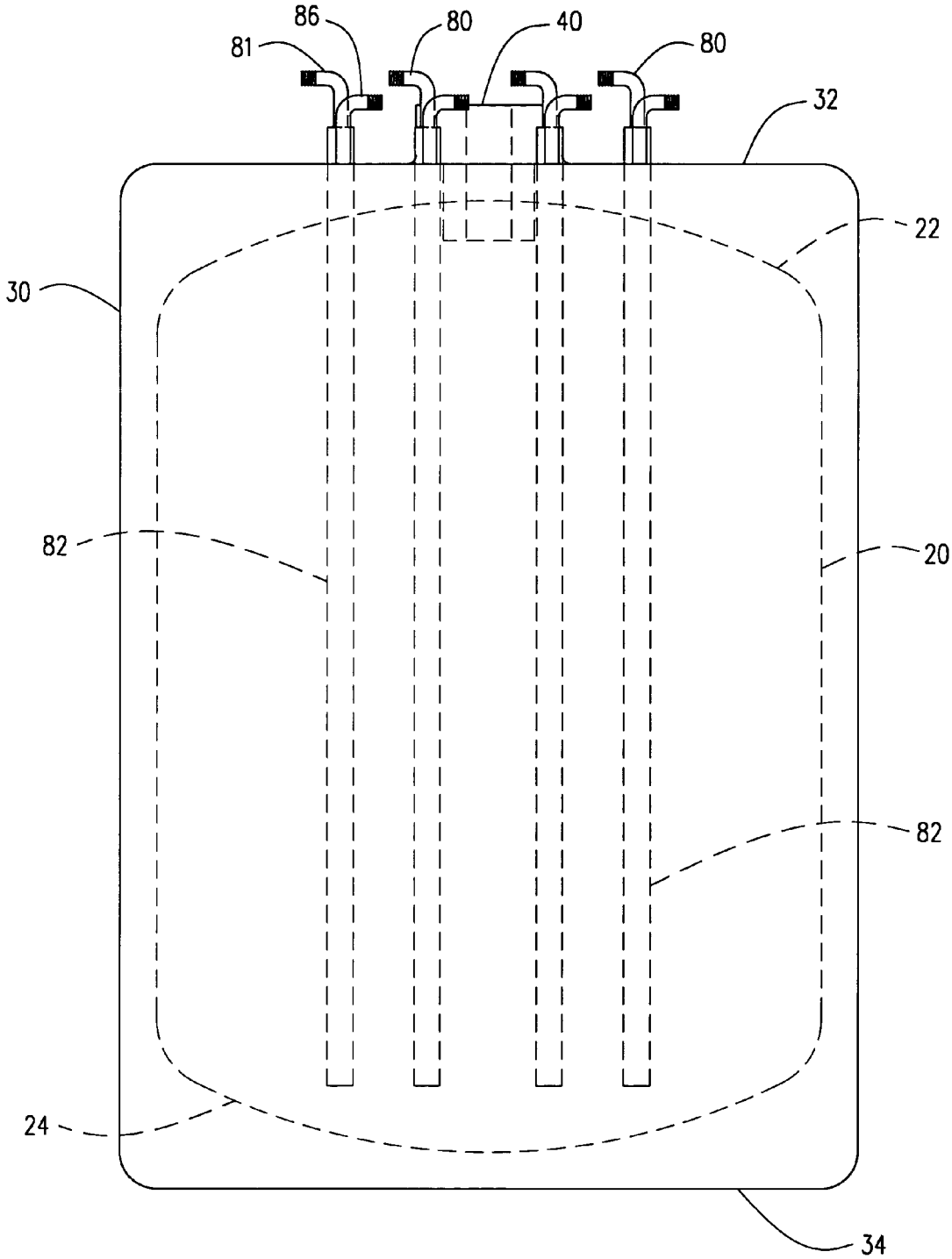

FIG. 12 is a side view of the outer tank indicating the placement of the plurality of syrup tubes within the inner tank.

Figure 13:
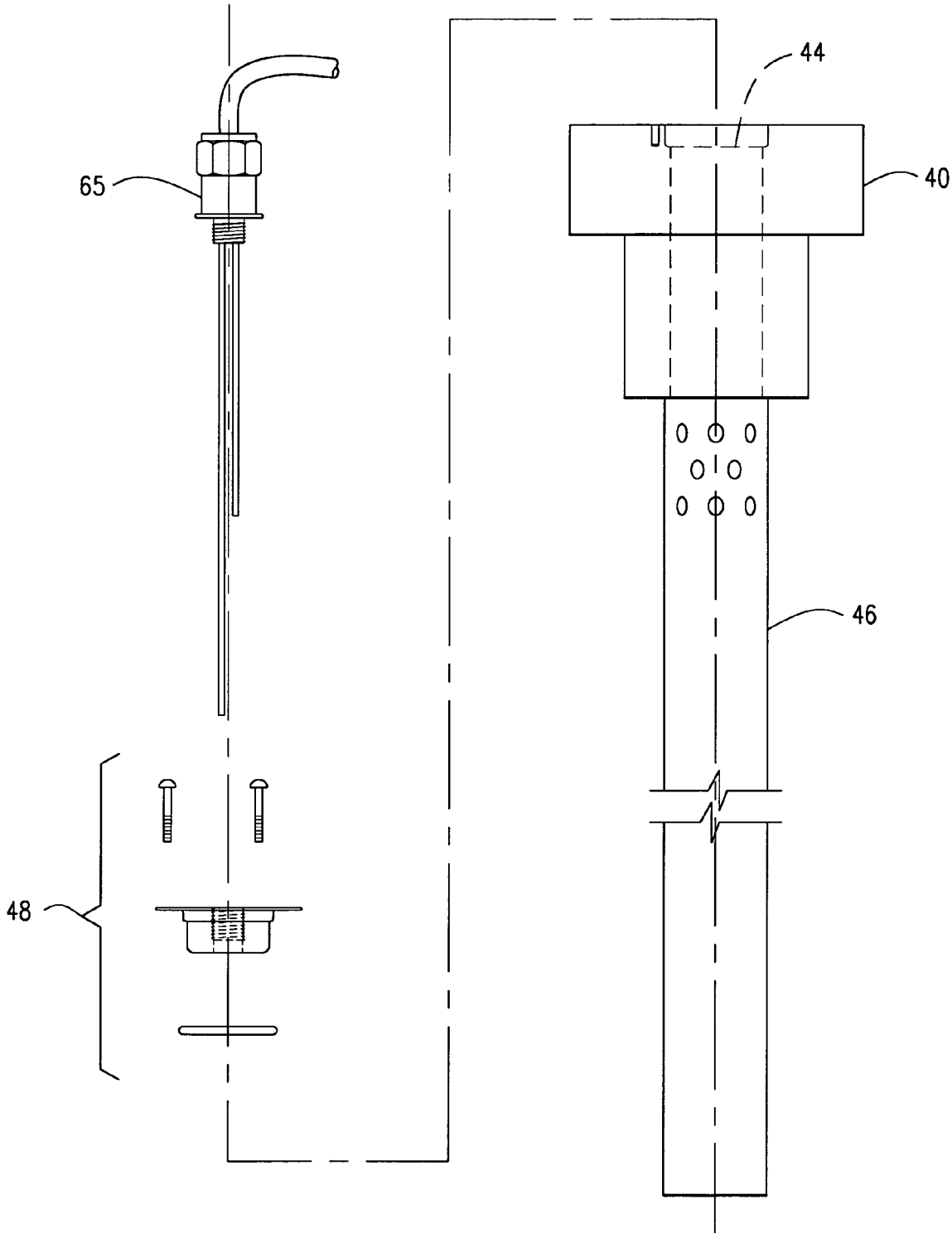

FIG. 13 is an exploded view of the fluid level probe, the hub and sleeve assembly.

IV. DESCRIPTION OF THE PREFERRED EMBODIMENT

Figure 1:
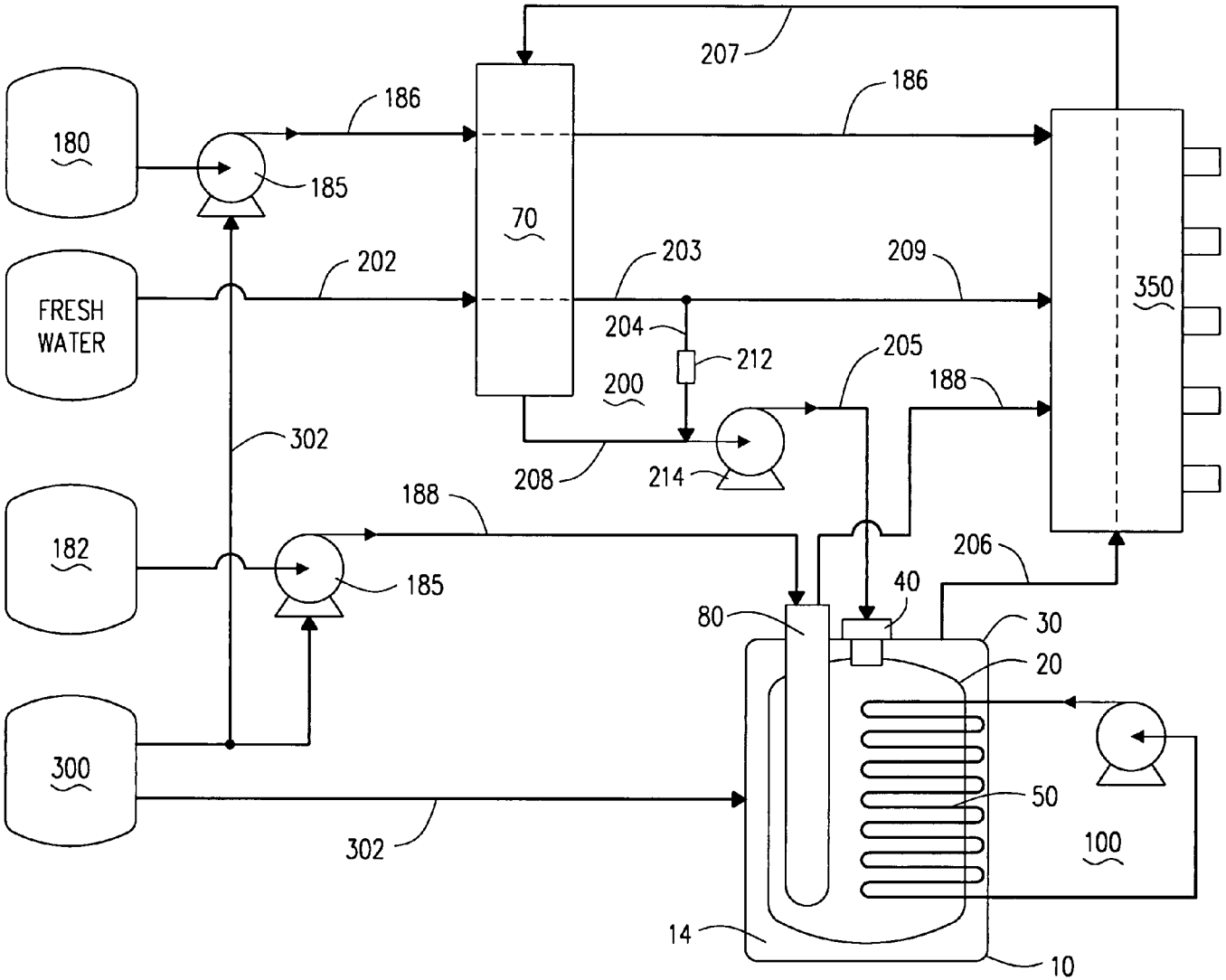
FIG. 1 is a flow diagram of the apparatus for delivering carbonated liquid at a temperature near or below the freezing point of water showing the integrated system.
Figure 2:
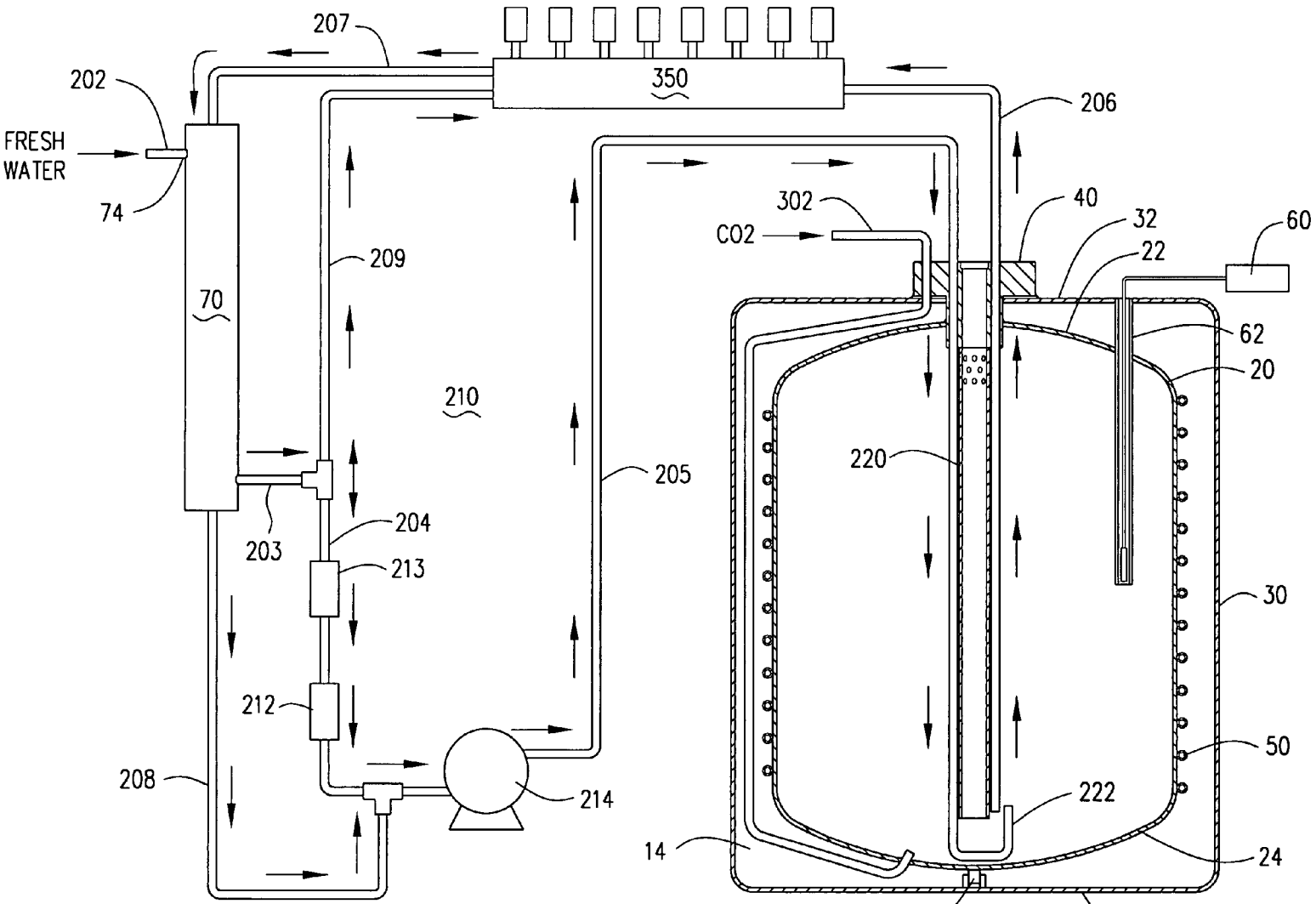
FIG. 2 is a flow diagram of the water circulation system.
Figure 3:
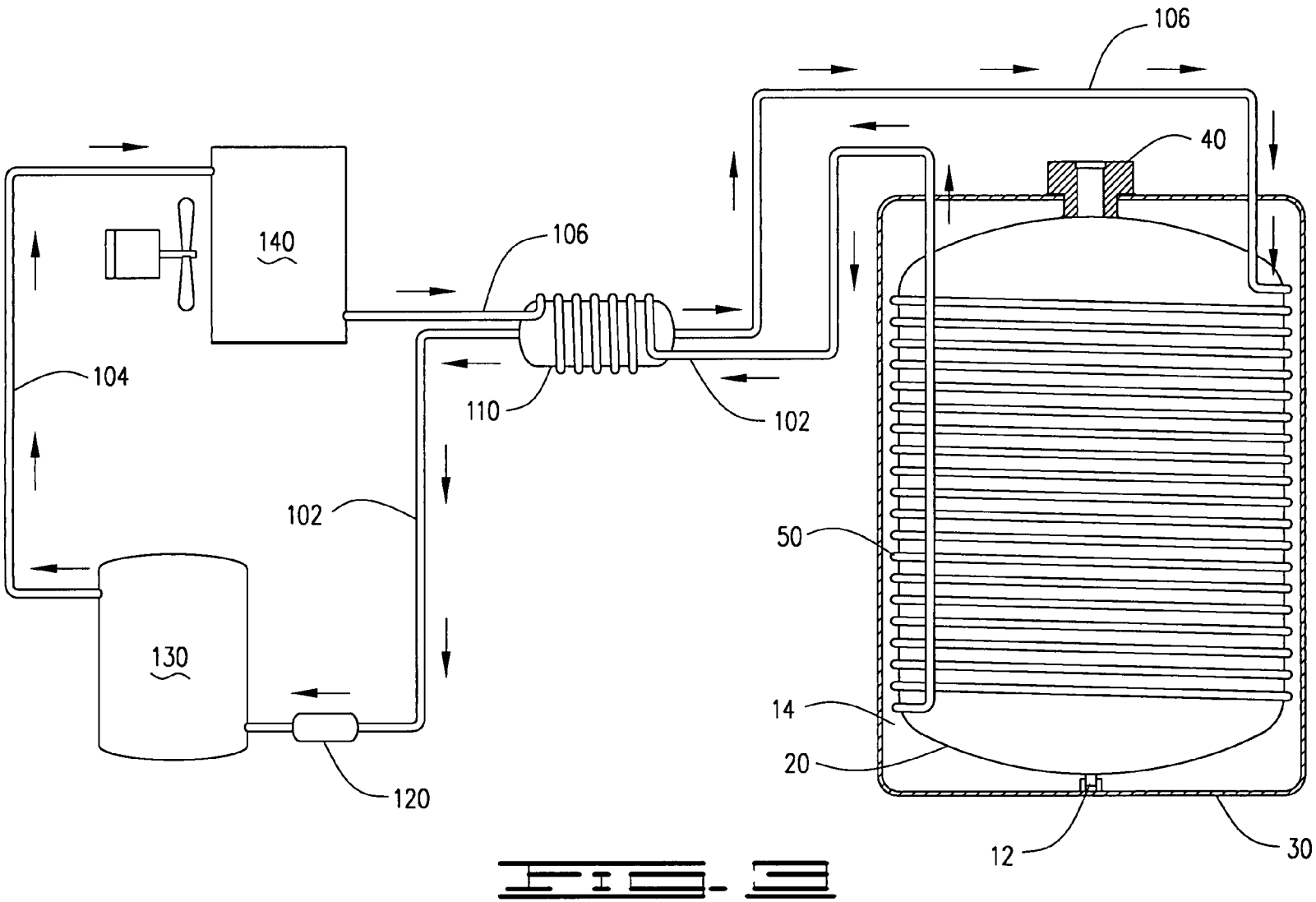
FIG. 3 is a flow diagram of the refrigerant system.
Figure 4:
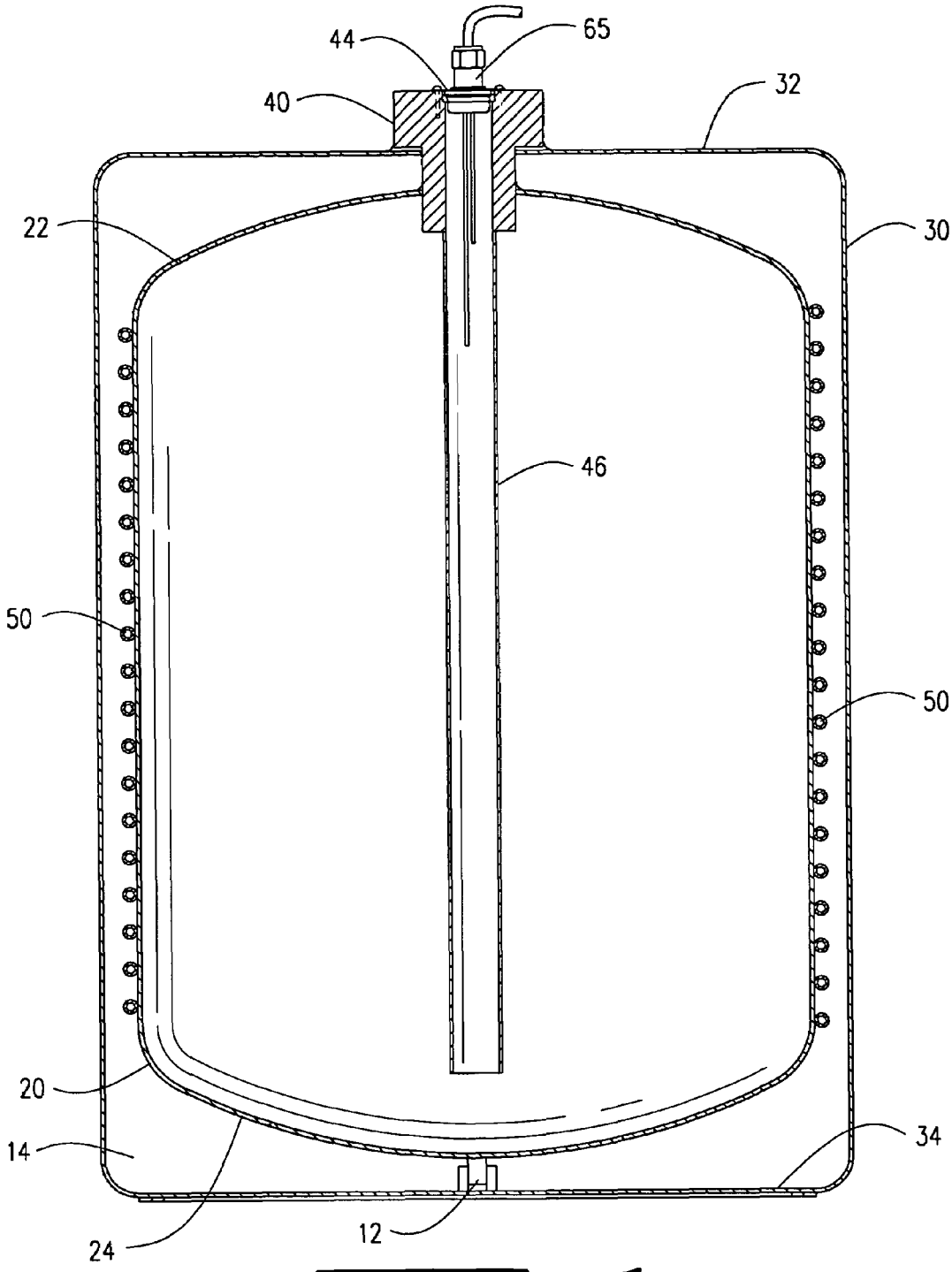
FIG. 4 is a cutaway side view of the inner and outer tank, the hub and the temperature probe and sleeve.
Figure 5:
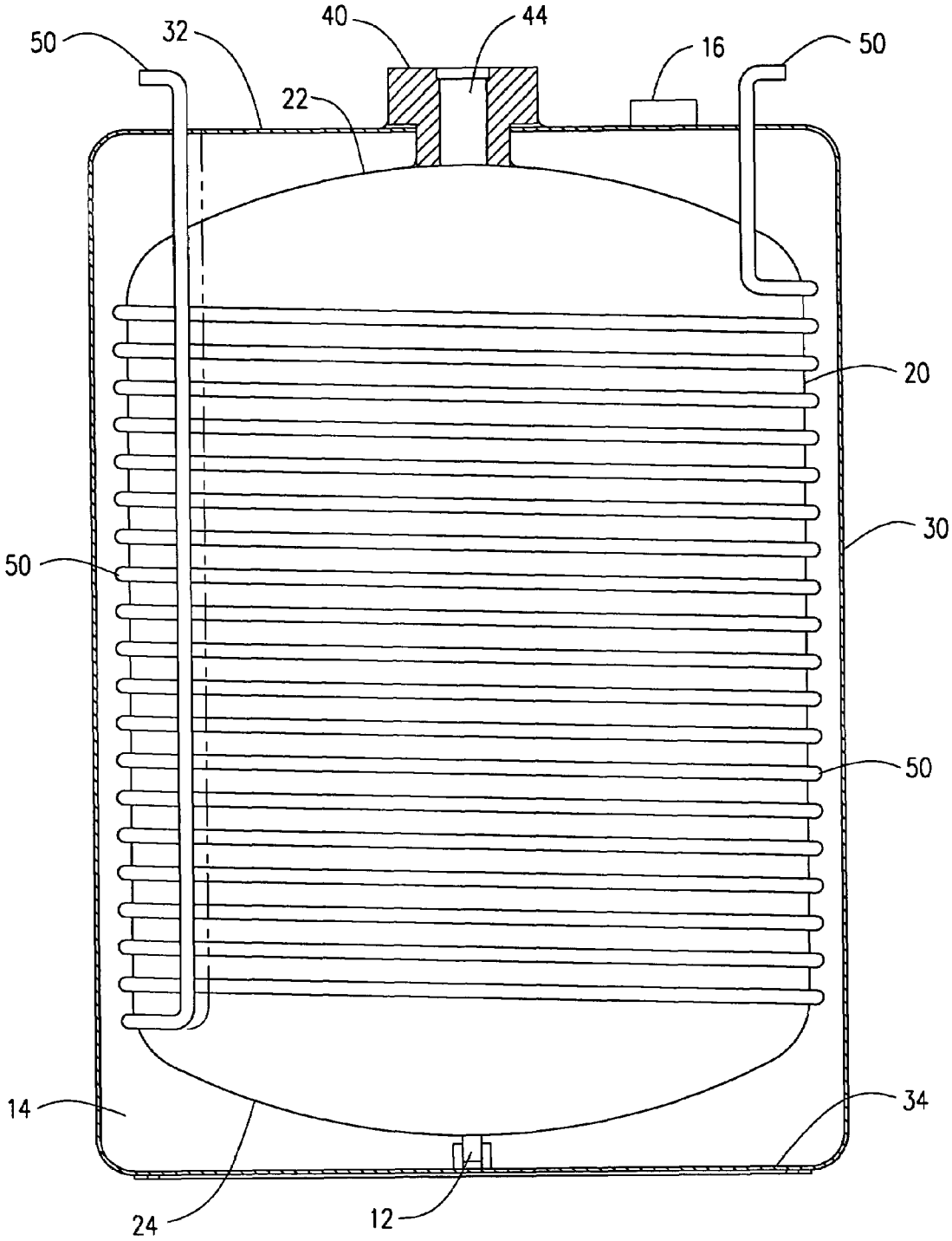
FIG. 5 is a side view of the inner tank within a cutaway side view of the outer tank.
Figure 6:
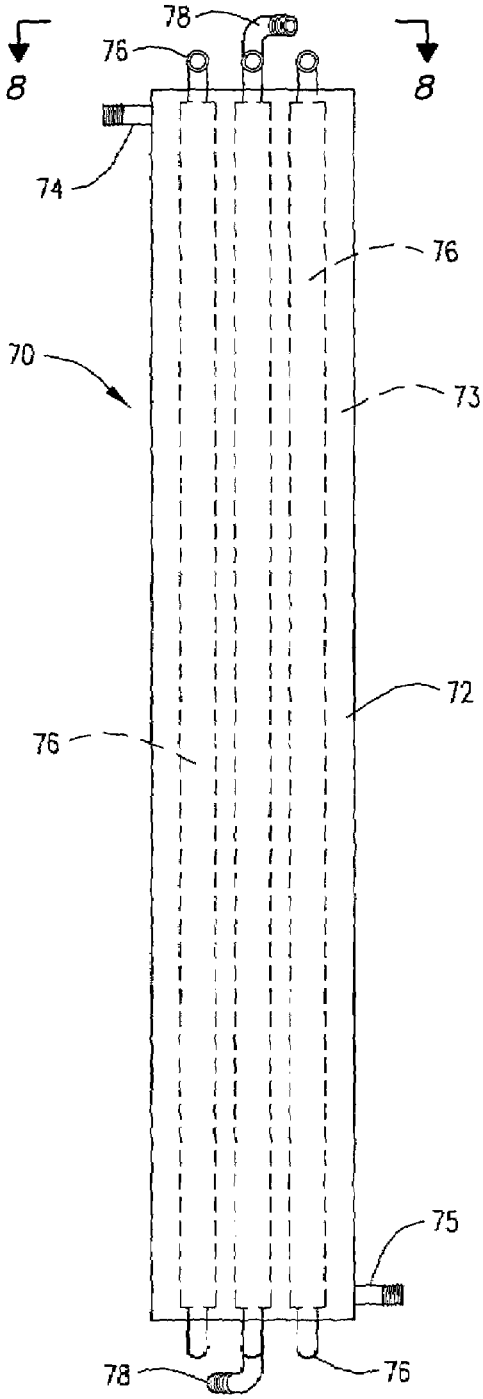
FIG. 6 is a front view of the heat exchange unit.

An apparatus for delivering a carbonated beverage at or near the freezing point of water, connected to a fresh water line, a carbon dioxide gas tank and a beverage syrup container which blends the fresh water, carbon dioxide gas and beverage syrup together for dispensing a cold soft drink is shown in FIGS. 1–13 of the drawings and comprises essentially a double tank carbonator 10, FIGS. 1–5, having an inner tank 20 and an outer tank 30, with an insulated void 14 between said inner tank 20 and outer tank 30, the inner tank 20 surrounded by a set of refrigerated cooling coils 50 integrated with a refrigerant circulating system 100, FIG. 3, a carbon dioxide cylinder 300 with compressed gas lines 302 directing carbon dioxide gas to the inner tank 20 and to a plurality of syrup pumps 185, a plurality of syrup lines 186, 188 connected to a plurality of syrup tanks 180, 182, including diet drink syrup tanks 180 and sugared syrup tanks 182, each syrup line 186, 188 connected to a separate syrup pump 185, a first fresh water line 202 providing fresh water to a heat exchange unit 70, FIGS. 6 and 8, and a second fresh water line 203 from the heat exchange unit 70 to a water circulating loop 210 in a water circulating system 200, FIG. 2, a fluid level probe 65 within the inner tank 20 regulating fresh water being delivered to the inner tank 20, and a temperature sensing means 60 within the inner tank 20 regulating the refrigerant circulating system 100. The fresh water and carbon dioxide are combined within the water circulating loop 210 to form soda water which is then directed through a pump 214 to the inner tank 20 to a soda water inlet line 205 where the soda water is chilled to a temperature at or below the freezing temperature of water, after which the soda water is delivered to the faucet bank 350, cycled through the heat exchange unit 350 and then returned to the water circulating loop 210, the diet syrup lines 186 running through the heat exchange unit 70 directly to the faucet bank 350 and the sugared syrup lines 188 connected to one of a plurality of syrup coils 80, FIGS. 7A, 7B, 9, 11 and 12, passing within the inner tank 20 of the double tank carbonator 10, further directed to the faucet bank 350, the faucet bank 350 blending the soda water with diet syrup for diet beverages, blending the soda water with sugared syrup for sugared beverages, a fourth fresh water line 209 dispensing fresh water at the faucet bank 350, for consumption or further mixing with tea or other non-carbonated beverages.

As further defined, the water circulating system 200, shown in FIG. 2, further comprises the first fresh water line 202 connected to the heat exchange unit 70, then to a second fresh water line 203 to the water circulating loop 210, the water circulating loop 210 having a check valve 212, a solenoid 213 and a water circulating pump 214, shown in FIG. 2 of the drawings. A third fresh water line 204 delivers fresh water to the water circulating loop 210, through the pump 214 to a soda water inlet line 205, then to a water inlet tube 220 within the inner tank 20 of the double tank carbonator 10 where fresh water and return soda water are further mixed with carbon dioxide to form the soda water chilled to a temperature at or below the freezing temperature of water and then directed through a soda water outlet line 206 to the faucet bank 350. From the faucet bank 350, a first return soda line 207 delivers the chilled soda water to a central soda water tube 78 in the heat exchange unit 70 to a second return soda line 208 which connects to the third fresh water line 204, the soda water prevented from entry into the third fresh water line 204 by the check valve 212. This water circulating system keeps the fresh water and soda water under pressure from the carbon dioxide gas circulating within the system so the liquids do not freeze within the system, such liquids being near or below their normal freezing points.

As the carbonated liquid in mixed within the inner tank 20 and the temperature reaches the freezing point of water, an ice bank will be formed within the inner tank 20. The temperature sensing means 60, again indicated in FIG. 2 of the drawings, should be housed within a sealed channel 62 penetrating through the outer tank 30 and the inner tank 20 terminating near where the ice bank would be formed. The temperature sensing means 60 is integrated with the refrigerant circulating system 100, deactivating the refrigerant circulating system 100 by sensing the temperature of the carbonated water within the inner tank as it reaches a determined set point.

The refrigerant circulating system 100 is further defined in FIG. 3, as having the set of refrigerated cooling coils 50 attached to the inner tank 20 within the void 14 between the inner tank 20 and the outer tank 30, the void being filled with either a vacuum or a highly insulating expansion foam completely filling the void 30. The refrigerated cooling coils 50 are connected to a first refrigerant line 102, passing over an accumulator 110, through a dryer 120 to a compressor 130, to a second refrigerant line 104 directed to a condenser unit 140, to a third refrigerant line 106 traveling back over the accumulator 110 to the refrigerated cooling coils 50. The refrigerant circulating system 100 is filled with a compressed refrigerated gas which under compression, is delivered at a temperature below the freezing point of water. The refrigerant circulating system 100 is regulated by the temperature sensing means 60.

The double tank carbonator 10 is further defined in FIGS. 4 and 5, including the outer tank 30 containing the inner tank 20, a lower end 24 of the inner tank 20 suspended within a lower end 34 of the outer tank 30 by a support peg 12. The void 14 is located between the inner tank 20 and the outer tank 30, and as previously indicated, the void 14 is either drawn to a vacuum or is filled with the highly insulating expansion foam, with a seal cap 16, indicated in FIG. 5 of the drawings, giving access to the void 14 during the time of manufacture of the double tank carbonator 10. A hub 40, shown in FIGS. 4–5, 10 and 13, is attached to an upper end 32 of the outer tank, penetrating into an upper end 22 of the inner tank 20, the hub 40 having a central opening 44 attaching to a perforated inner cylinder 46 within which is inserted the fluid level probe 65, attached to the hub 40 by an attaching means 48, the fluid level probe 65 regulating the flow of fresh water into the inner tank 20. This fluid level probe 65 may be mechanical float mechanism or as an electronic bridge type probe, depicted in FIG. 13. The fluid level probe 65 is connected to the solenoid 213, which regulates the flow of fresh water into the water circulating loop 210, the fluid level probe 65 signaling the solenoid 213 to open to allow fresh water into the water circulating loop 210 when water in the inner tank 20 is low, and signaling the solenoid 213 to close to disallow fresh water into the water circulating loop 210 when the inner tank 20 is full.

The hub 40 has a plurality of holes 42, a first hole 42*a* accepting the compressed gas line 302 from the carbon dioxide cylinder 300 introducing carbon dioxide gas into the inner tank 20, a second hole 42*b* accepting the soda water inlet line 205 connected to the water inlet tube 220 forming a J-tube 222 within the inner tank 20, a third hole 42*c* accepting the soda water outlet line 206, and a fourth hole 42*d* provided for pressure relief. The J-tube 222, the compressed gas line 302 and the soda water outlet line 206 are directed to the lower end 24 of the inner tank 20. In the alternative, any of the lines running through the hub 40 may be introduced by direct line to the inner tank without passing through the hub, by penetration of the outer tank and inner tank.

The heat exchange unit 70, shown in FIGS. 6 and 8, further comprises a sealed cylindrical frame member 72 having an inner cavity 73 with a fresh water inlet 74 and a fresh water outlet 75, the fresh water inlet 74 connected to the first fresh water line 202 and the fresh water outlet 75 connected to the water circulating loop 210 through the second fresh water line 203. Within the heat exchange unit 70 are a plurality of diet syrup tubes 76 through which the diet syrup passes, the diet syrup tubes 76 connecting to the diet syrup lines 186, cooling the diet syrup within the diet syrup lines 186 prior to terminating at the faucet bank 350. The heat exchange unit 70 may be attached to the outer tank 30 of the double tank carbonator 10 by a bracket 77, shown in FIG. 8 of the drawings. A central soda line 78 also runs within the inner cavity 73, connected between the first return soda line 207 and the second soda return line 208 providing the heat exchange unit with the capacity to lower the temperature of the fresh water flowing through the inner cavity 73 and the diet syrup within the diet syrup tubes 76.

Each of the syrup coils 80, shown in FIGS. 7A, 7B and 9 of the drawings, is a closed tube having a syrup inlet 81 connected to a sugared syrup line 188 introducing the sugared syrup into the syrup coil 80 which further has an outer syrup tube 82 with an interior surface 83 aligned with a multiplicity of inwardly protruding dimples 84 to create a turbulence within the syrup coil 80. A syrup outlet 86, connected to an internal outlet tube 87 is located within the outer syrup tube 82 to extract the sugared syrup from within the outer syrup tube 82. This syrup outlet 86 is connected to the faucet bank 350. Each syrup coil 80 may be secured within the double tank carbonator 10 as indicated in FIGS. 11–12 of the drawings.

Most preferably the double tank carbonator 10 is made entirely of stainless steel, which is demonstrated to have the desired thermal qualities sought in the apparatus. The cooling coils 50 are preferably copper which is attached by soldering the formed copper to the inner tank 20. The hub 40 is best presented as a stainless steel hub with the plurality of holes 42 machined through the hub 40 leading into the inner tank 20. The heat exchange unit 70 would preferably be made of stainless steel or another metal which would not be subject to corrosion and would have the thermal qualities required to operated the apparatus efficiently. The syrup coils 80 would also be made of similar metal materials with the interior surface 83 of the syrup coils 80 having a smooth surface or inner lining that would be resistant to a buildup of syrup over time.

The water lines and syrup lines within the apparatus would be best suited if made from stainless steel or copper with like metal couplings, although the current art uses flexible plastic hoses to connect most syrup containers and carbon dioxide cylinders to soft drink dispensers. Flexible plastic hoses would be sufficient for the lines connecting the external carbon dioxide cylinder and the external syrup containers to the apparatus, but likely not sufficient to be use for connecting the inner components of the apparatus.

It is also preferred that the inner tank 20 and outer tank 30 be a cylindrical shape with the upper end 22 and lower end 24 of the inner tank 20 and the upper end 32 and the lower end 34 of the outer tank 30 being domed, which is preferred in the art for stability of the tanks under the pressure of a vacuum or under the pressure of a highly insulating expansion foam filling the void 14 between the inner tank 20 and outer tank 30.

In addition to its implementation into the apparatus, the double tank carbonator 10 may by itself be incorporated into current art soft drink dispensing devices and is therefore independently made part of the specification. This independent embodiment of the double tank carbonator 10 comprises the inner tank 20 suspended with the outer tank 30, the void 14 between the inner tank and outer tank again being occupied by a vacuum or highly insulating expansion foam, with the double tank carbonator 10 having the hub 40 accepting the third fresh water line 204 and the compressed gas line 302 from the carbon dioxide cylinder 300, and having a soda water outlet line 206 connecting to a faucet bank 350. Syrup coils 80 may be integrated within the double tank carbonator 10 with a syrup inlet 81 connecting to the syrup lines 186, 188 and a syrup outlet 86 connecting the syrup coil 80 to the faucet bank 350. The cooling coils 50 located with the void 14 may be connected to an outside refrigerant circulating system 100 with the temperature sensing means 60, housed within a sealed channel 62 penetrating through the outer tank 30 and inner tank 20, controlling the refrigerant circulating system 100. The fluid level probe 65, contained within the perforated inner cylinder 46, inserted through the central opening 44 of the hub 40, may be integrated with any fresh water line to control the flow of fresh water into the inner tank 20.

While the invention has been particularly shown and described with reference to a preferred embodiment thereof, it will be understood by those skilled in the art that changes in form and detail may be made therein without departing from the spirit and scope of the invention.

What is claimed is:

1. An apparatus for delivering a carbonated beverage at or near the freezing point of water, blending fresh water, carbon dioxide gas and beverage syrup together for dispensing a cold soft drink at a faucet bank, comprises essentially:

a double tank carbonator having an inner tank contained within an outer tank, with an insulated void between said inner tank and said outer tank, said inner tank surrounded by and attached to a set of refrigerated cooling coils attached to a refrigerant circulating system;

a compressed gas line connected to a carbon dioxide cylinder, directing carbon dioxide gas to the inner tank and to a plurality of syrup pumps;

a plurality of diet syrup lines and a plurality of sugared syrup lines, each of said plurality of diet syrup lines connected to a diet syrup tank, and each of said plurality of sugared syrup lines connected to a sugared syrup tank, each of said plurality of diet syrup lines and each of said plurality of sugared syrup lines passing through one of said plurality of syrup pumps, said plurality of diet syrup lines further directed through a heat exchange unit to said faucet bank, each of said plurality of sugared syrup lines passing through one of said plurality of syrup pumps to a syrup coil, said syrup coil passing within said inner tank, said syrup coil further attached to said faucet bank;

a water circulating system comprising a first fresh water line to said heat exchange unit, a second fresh water line from said heat exchange unit to a water circulating loop delivering fresh water to said faucet bank and to said inner tank with a soda water outlet line connecting said inner tank to said faucet bank, a first return soda line connecting said faucet bank to a central soda water tube within said heat exchange unit and a second return soda line connecting said central soda water tube to said water circulating loop;

a fluid level probe within said inner tank integrated with and controlling said water circulating loop;

a temperature sensing means within said inner tank integrated with and controlling said refrigerant circulating system;

a lower end of said inner tank suspended within a lower end of said outer tank by a support peg;

a seal cap allowing access to said void through an upper end of said outer tank; and a hub attached to said upper end of said outer tank, said hub further penetrating into an upper end of said inner tank, said hub having a central opening attaching to a perforated inner cylinder within which is inserted said fluid level probe, said fluid level probe attached within said central opening of said hub by an attaching means, said fluid level probe regulating the flow of fresh water into said inner tank through said solenoid.

2. The apparatus as disclosed in claim 1, said water circulating system further comprising:

said first fresh water line is connected to the heat exchange unit said second fresh water line is connected to said water circulating loop having a third fresh water line including a check valve, a solenoid and a water circulating pump;

said fourth fresh water line delivering fresh water to said faucet bank;

a soda water inlet line connected to a water inlet tube within said inner tank of said double tank carbonator, wherein said fresh water a return soda water is further mixed with said carbon dioxide gas in said inner tank forming soda water chilled to a temperature at or below the freezing temperature of water;

the soda water outlet line connecting said inner tank with said faucet bank delivering soda water to said faucet bank;

the first return soda line connecting said faucet bank to said central soda water tube within said heat exchange unit; and the second return soda line connecting said central soda water tube to said water circulating loop.

3. The apparatus as disclosed in claim 1, said refrigerant circulating system is further comprising:

said set of refrigerated cooling coils attached to said inner tank within said void between said inner tank and said outer tank, said void occupied by a vacuum;

further said set of refrigerated cooling coils connected to an first refrigerant line passing over an accumulator, through a dryer to a compressor;

a second refrigerant line from said compressor directed to a condenser unit; and a third refrigerant line from said condenser unit passing back over said accumulator to said refrigerated cooling coils, said refrigerant circulating system filled with a compressed refrigerated gas delivered to said set of refrigerated cooling coils at a temperature below the freezing point of water, said refrigerant circulating regulated by said temperature sensing means; and said temperature sensing means housed within a sealed channel penetrating through said outer tank and said inner tank, said temperature sensing means integrated with said refrigerant circulating system, operating said refrigerant circulating system to regulate the temperature of the carbonated water within the inner tank.

4. The apparatus as disclosed in claim 1, said refrigerant circulating system is further comprising:

said set of refrigerated cooling coils attached to said inner tank within said void between said inner tank and said outer tank, said void occupied by a highly insulating expansion foam;

further said set of refrigerated cooling coils connected to an first refrigerant line passing over an accumulator, through a dryer to a compressor;

a second refrigerant line from said compressor directed to a condenser unit; and a third refrigerant line from said condenser unit passing back over said accumulator to said refrigerated cooling coils, said refrigerant circulating system filled with a compressed refrigerated gas delivered to said set of refrigerated cooling coils at a temperature below the freezing point of water, said refrigerant circulating regulated by said temperature sensing means; and said temperature sensing means housed within a sealed channel penetrating through said outer tank and said inner tank, said temperature sensing means integrated with said refrigerant circulating system, operating said refrigerant circulating system to regulate the temperature of the carbonated water within the inner tank.

5. The apparatus as disclosed in claim 1, said double tank carbonator, said inner tank and said outer tank further comprising:

said central opening of said hub by an attaching means, said fluid level probe regulating the flow of fresh water into said inner tank through said solenoid; and said hub having a plurality of holes, a first hole accepting said compressed gas line from said carbon dioxide cylinder, a second hole accepting said soda water inlet line connected to a J-tube positioned within said inner tank, a third hole accepting said soda water outlet line, and a fourth hole providing for pressure relief to said inner tank, said J-tube, said compressed gas line and said soda water outlet line directed to said lower end of said inner tank.

6. The apparatus as disclosed in claim 1, said heat exchange unit further comprising:

a sealed cylindrical frame member having an inner cavity with a water inlet and a water outlet, said water inlet connected to said first fresh water line and said water outlet connected to said water circulating system through said second fresh water line;

said central soda water tube within said inner cavity connected between said first return soda line and said second return soda line; and a plurality of diet syrup tubes connecting to said diet syrup lines prior to connection of said diet syrup lines to said faucet bank.

7. The apparatus as disclosed in claim 1, each of said syrup coils forming a closed tube, further comprising:

a syrup inlet connected to said sugared syrup line;

an outer syrup tube having an interior surface aligned with a multiplicity of inwardly protruding dimples; and a syrup outlet, connected to an internal outlet tube located within said outer syrup tube, said internal outlet tube extracting sugared syrup from said outer syrup tube, said syrup outlet connected to said faucet bank, each said syrup coil secured within the double tank carbonator.

8. The apparatus as disclosed in claim 1, wherein:

said fluid level probe regulating the flow of fresh water into said inner tank, and said hub having a plurality of holes, a first hole accepting said compressed gas line from said carbon dioxide cylinder, a second hole accepting said soda water outlet line attaching to said water inlet tube connected to a J-tube positioned within said inner tank, a third hole accepting said soda water outlet line, and a fourth hole providing for pressure relief to said inner tank, said J-tube, said compressed gas line and said carbonated water outlet line directed to said lower end of said inner tank;

said refrigerant circulating system is further comprises said set of refrigerated cooling coils attached to said inner tank within an insulating void between said inner tank and said outer tank, further said set of refrigerated cooling coils connected to an first refrigerant line passing over an accumulator, through a dryer to a compressor, a second refrigerant line from said compressor directed to a condenser unit; and a third refrigerant line from said condenser unit passing back over said accumulator to said refrigerated cooling coils, said refrigerant circulating system filled with a compressed refrigerated gas delivered to said set of refrigerated cooling coils at a temperature below the freezing point of water, said refrigerant circulating regulated by said temperature sensing means; and said temperature sensing means housed within a sealed channel penetrating through said outer tank and said inner tank, said temperature sensing means integrated with said refrigerant circulating system, operating said refrigerant circulating system to regulate the temperature of the carbonated water within the inner tank;

said second fresh water line is connected to said water circulating loop having a third fresh water line including a check valve, a solenoid connected to said fluid level probe to regulate the flow of fresh water into the water circulating loop, and a water circulating pump, said fourth fresh water line delivering fresh water to said faucet bank, a soda water inlet line connected to a water inlet tube within said inner tank of said double tank carbonator, wherein said fresh water a return soda water is further mixed with said carbon dioxide gas in said inner tank forming soda water chilled to a temperature at or below the freezing temperature of water, a soda water outlet line connecting said inner tank with said faucet bank delivering soda water to said faucet bank, a first return soda line connecting said faucet bank to said central soda water tube within said heat exchange unit, and a second return soda line connecting said central soda water tube to said water circulating loop;

said heat exchange unit further comprises a sealed cylindrical frame member having an inner cavity with a water inlet and a water outlet, said water inlet connected to said first fresh water line and said water outlet connected to said water circulating system by said second fresh water line, a central soda water tube within said inner cavity, said central water tube connected between said first soda return line and said second soda return line, and a plurality of diet syrup tubes connecting to said diet syrup lines prior to connection of said diet syrup lines to said faucet bank; and each of said syrup coils forming a closed tube, further comprises a syrup inlet connected to said sugared syrup line, an outer syrup tube having an interior surface aligned with a multiplicity of inwardly protruding dimples, and a syrup outlet, connected to an internal outlet tube located within said outer syrup tube, said internal outlet tube extracting sugared syrup from said outer syrup tube, said syrup outlet connected to said faucet bank, each said syrup coil secured within the double tank carbonator.

9. A double tank carbonator adapted for use within a soft drink beverage dispenser for mixing fresh water and carbon dioxide forming carbonated water, lowering the temperature of said carbonated water to a temperature at or below the freeing temperature of water, comprising:

an inner tank contained within an outer tank, said inner tank surrounded by and attached to a set of refrigerated cooling coils connected to a refrigerant circulating system;

an insulated void between said inner tank and said outer tank;

a hub attached to an upper end of said outer tank, said hub further penetrating into an upper end of said inner tank having a central opening attaching to a perforated inner cylinder within which is inserted a fluid level probe, said fluid level probe attached within said central opening of said hub by an attaching means, said fluid level probe connected to a solenoid providing fresh water to said inner tank, regulating said amount of fresh water into said inner tank, said hub further comprising a plurality of holes, a first hole accepting said compressed gas line from said carbon dioxide cylinder, a second hole accepting fresh water connected to a water inlet tube which terminates into a J-tube positioned within said inner tank, a third hole accepting said carbonated water outlet line, and a fourth hole providing for pressure relief to said inner tank, said J-tube, said compressed gas line and said carbonated water outlet line directed to a lower end of said inner tank; and a temperature sensing means, housed within a sealed channel penetrating through said outer tank and said inner tank, regulating said refrigerant circulating system.

10. The double tank carbonator, as disclosed in claim 9, wherein said insulated void is occupied by a vacuum.

11. The double tank carbonator, as disclosed in claim 9, further comprising:

said lower end of said inner tank suspended within said lower end of said outer tank by a support peg; and a seal cap allowing access to said void through said upper end of said outer tank.

* * * * *